US005257879A

United States Patent [19]

Veronelli

[11] Patent Number: 5,257,879

[45] Date of Patent: Nov. 2, 1993

[54] DEVICE FOR LIFTING AND HAMMERING FOUNDATION PILES FOR OFFSHORE STRUCTURES

[75] Inventor: Paolo Veronelli, Milan, Italy

[73] Assignee: Saipem S.p.A., Milan, Italy

[21] Appl. No.: 898,470

[22] Filed: Jun. 15, 1992

[30] Foreign Application Priority Data

Jun. 28, 1991 [IT] Italy ..... MI91 A 001793

[51] Int. Cl.[5] ..... E02D 7/08

[52] U.S. Cl. ..... 405/228; 173/81; 405/232; 405/227

[58] Field of Search ..... 405/228, 227, 232, 231, 405/303; 335/290; 294/65.5; 414/790; 173/29, 84, 81, 89, 86, 126

[56] References Cited

U.S. PATENT DOCUMENTS 3,526,283 9/1970 Horstketter et al. ..... 173/126
3,680,644 8/1972 Doughty ..... 405/228 X
4,257,720 3/1981 Ostgaard ..... 405/228 X
4,362,439 12/1982 Vaynkof ..... 405/228
4,817,734 4/1989 Kuehn ..... 405/228 X
4,844,661 7/1989 Martin et al. ..... 405/228 X

FOREIGN PATENT DOCUMENTS 0265566 10/1986 European Pat. Off. .

*Primary Examiner*—Dennis L. Taylor
*Attorney, Agent, or Firm*—Morgan & Finnegan

[57] ABSTRACT

A device for lifting and hammering the foundation piles of offshore structures, consisting of a long support element having a length of the order of twenty meters, to be inserted into the foundation pile which is to be driven into the sea bed, said element being suspended from a crane and being provided at its lower end with an expansion-type gripping clamp and at its upper end with a hammering system comprising a striking weight or hammer slidable along said support element until a limit stop is reached. Preferred embodiments are also provided.

4 Claims, 4 Drawing Sheets

DEVICE FOR LIFTING AND HAMMERING FOUNDATION PILES FOR OFFSHORE STRUCTURES

This invention relates to a new hammering device which allows effective, reliable, rapid and in particular controlled installation of foundation piles for offshore structures, by enabling the pile to be lifted and the hammering energy matched to the ground characteristics, and by eliminating any danger of resonance.

It is well known that offshore structures are fixed to the sea bed by foundation piles, which are lifted and positioned in suitable guides in the structure and are then hammered until they have penetrated a predetermined distance into the ground by a pile driver.

In the current state of the art the foundation piles have to be lifted and positioned by external pile gripping clamps and cranes situated on a pontoon for offshore work, and then hammered by a pile driver which is suspended from a crane and rested on the head of the pile to be driven into the ground, and comprises a mechanically or hydraulically operated hammer.

In addition to requiring the use of several separate implements with a consequent considerable wastage of operating time and cost, this known method has a series of drawbacks, of which the main one is the fact that as the pile has a considerable free length and is subjected to waves having an oscillation frequency close to that of the pile itself, dangerous resonance conditions can be produced which in addition to generating considerable stresses in the pile which can cause its undesirable deformation, also make it materially impossible to install the pile driver on the head of the oscillating pile.

The object of the present invention is to obviate the aforesaid drawbacks by providing a device which has the double function of lifting the foundation pile to be driven into the sea bed and preventing any dangerous resonance of the pile.

This object is substantially attained in that the device is formed with a long support element to be inserted into the foundation pile to be driven into the sea bed, said support element being suspended from a crane situated on a pontoon for offshore work and being provided at its lower end with an expansion-type gripping clamp for said pile and at its upper end with a hammering system comprising a striking weight or hammer slidable along said support element until a limit stop present on said element is reached. In this manner, while the gripping clamp makes it possible to lock the foundation pile, lift it at will and then insert it into the pile guides present in the offshore structure, said support element eliminates any danger of resonance by being inserted freely into the foundation pile to a length of the order of twenty meters and maintaining a constant tension within the pile which creates opposing forces to the horizontal movement of the pile head. Hence, the device for lifting and hammering the foundation piles of offshore structures, said device comprising a striking weight or hammer slidable along a guide suspended from a crane situated on a pontoon for offshore work, is characterised according to the present invention in that said guide consists of a long support element to be inserted into the foundation pile to be driven into the sea bed, said element being provided at its lower end with an expansion-type gripping clamp for said pile and at its upper end with an electromagnet cooperating with said striking weight or hammer of ferrous material slidable along said support element until a limit stop present on said element is reached.

According to a preferred embodiment of the present invention, said hammering system consists of a striking weight or hammer of ferrous material cooperating with an electromagnet fixed to the upper end of said long support element.

The invention is described in detail hereinafter with reference to the accompanying drawings which illustrate a preferred embodiment thereof by way of non-limiting example only, in that technical or constructional modifications can be made thereto but without leaving the scope of the present invention. For example, said hammering system comprising an electromagnet and a striking weight or hammer of ferrous material can be applied to a support element without expansion-type gripping clamps and hence operating as a conventional pile driver.

Figure 1:
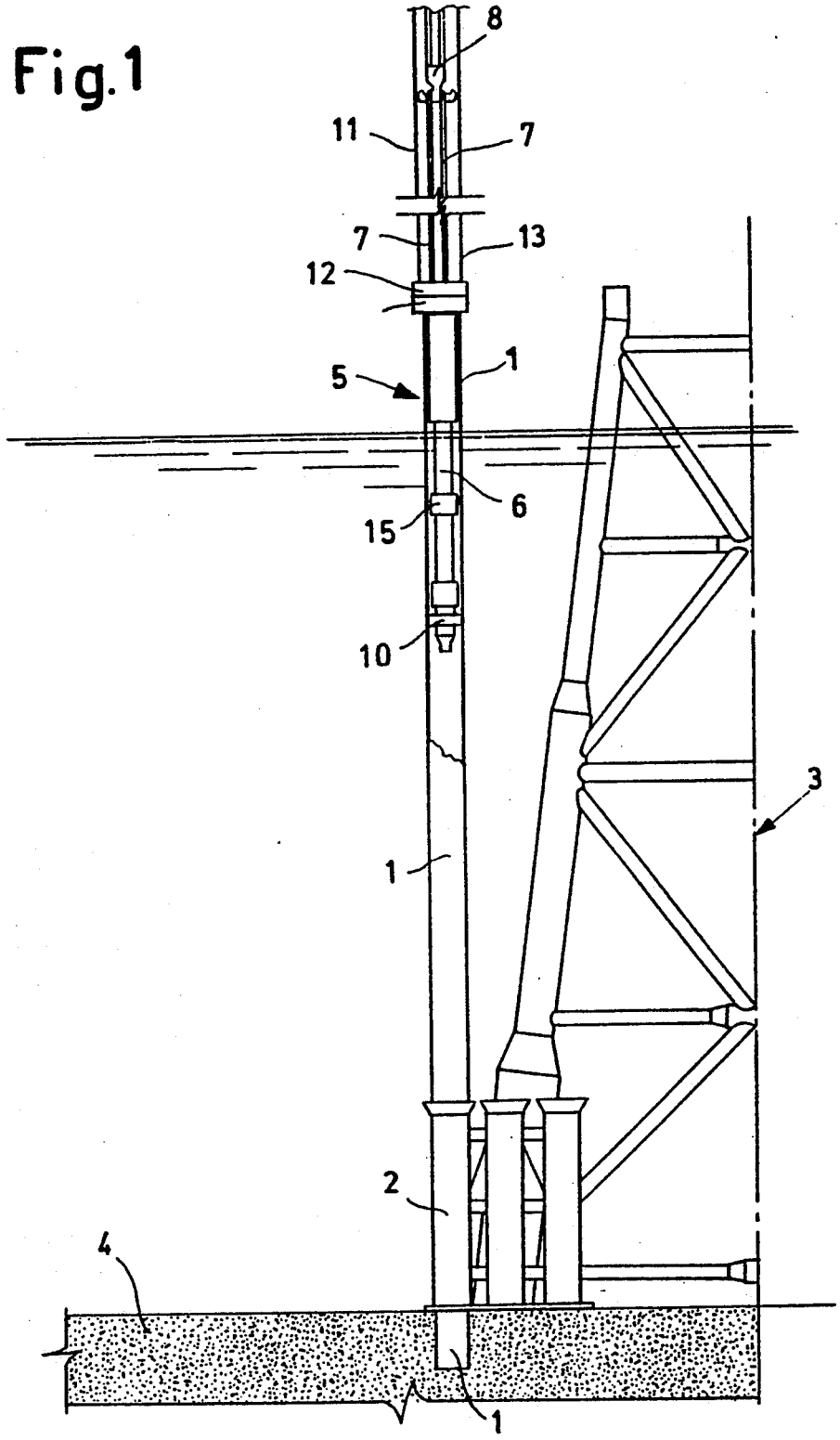
FIG. 1 is a partly sectional partial side view showing the insertion of a foundation pile into a relative guide in an offshore structure by means of a lifting and hammering device formed in accordance with the present invention.

With reference to the FIGS. 1 indicates a foundation pile which is to be inserted into the appropriate guide 2 of the offshore structure 3 and then driven into the sea bed 4 by hammering until a predetermined penetration is achieved.

This is done by using the lifting and hammering device 5 of the invention, consisting of a long support element 6 which has to be completely inserted into said pile 1. Said element 6 is held suspended from a crane, not shown in the figures, situated on a pontoon for offshore work, also not shown in the figures, by a sling 7 connected to the hook 8 of said crane and shackled at 9 to the lower end of the element, where it is provided with an expansion-type gripping clamp 10 operated hydraulically from said pontoon via a hose 11. A typical expansion-type gripping clamp, suitable for use in connection with the present invention, is shown and described in U.S. Pat. No. 3,526,283 granted Sep. 1, 1970 to E. A. Horstketter et al. for "Pile Driver." At its other end the support element 6 comprises, rigid therewith, an electromagnet 12 activated via the power cable 13, to cooperate with the striking weight or hammer 14 slidable along said support element 6 as far as a limit stop 15 provided on the support element 6.

The device operates in the following manner.

Figure 4:
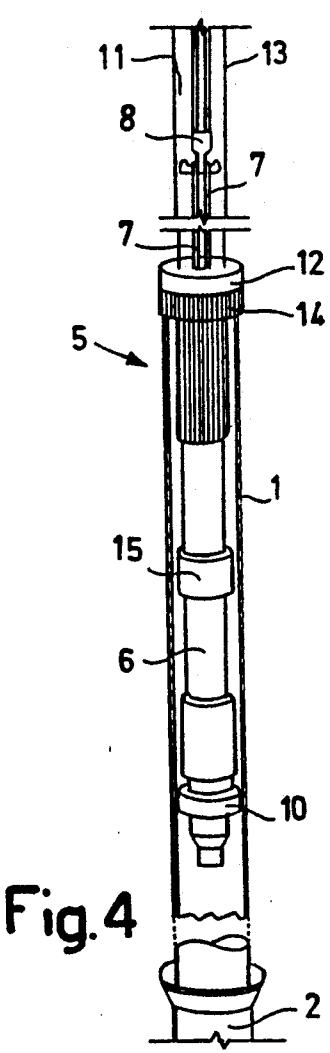

After the lifting and hammering device 5 has been completely inserted into the foundation pile 1, its expansion-type gripping clamp 10 is hydraulically tightened against the inner wall of the pile while the energized electromagnet 12 retains the hammer 14, which hence rests on the head of the pile 1. By this means the foundation pile 1 can be lifted by the crane and positioned in the relative guide 2 of the offshore structure 3 to be fixed to the sea bed 4 (see FIGS. 1 and 4 specifically).

Figure 2:
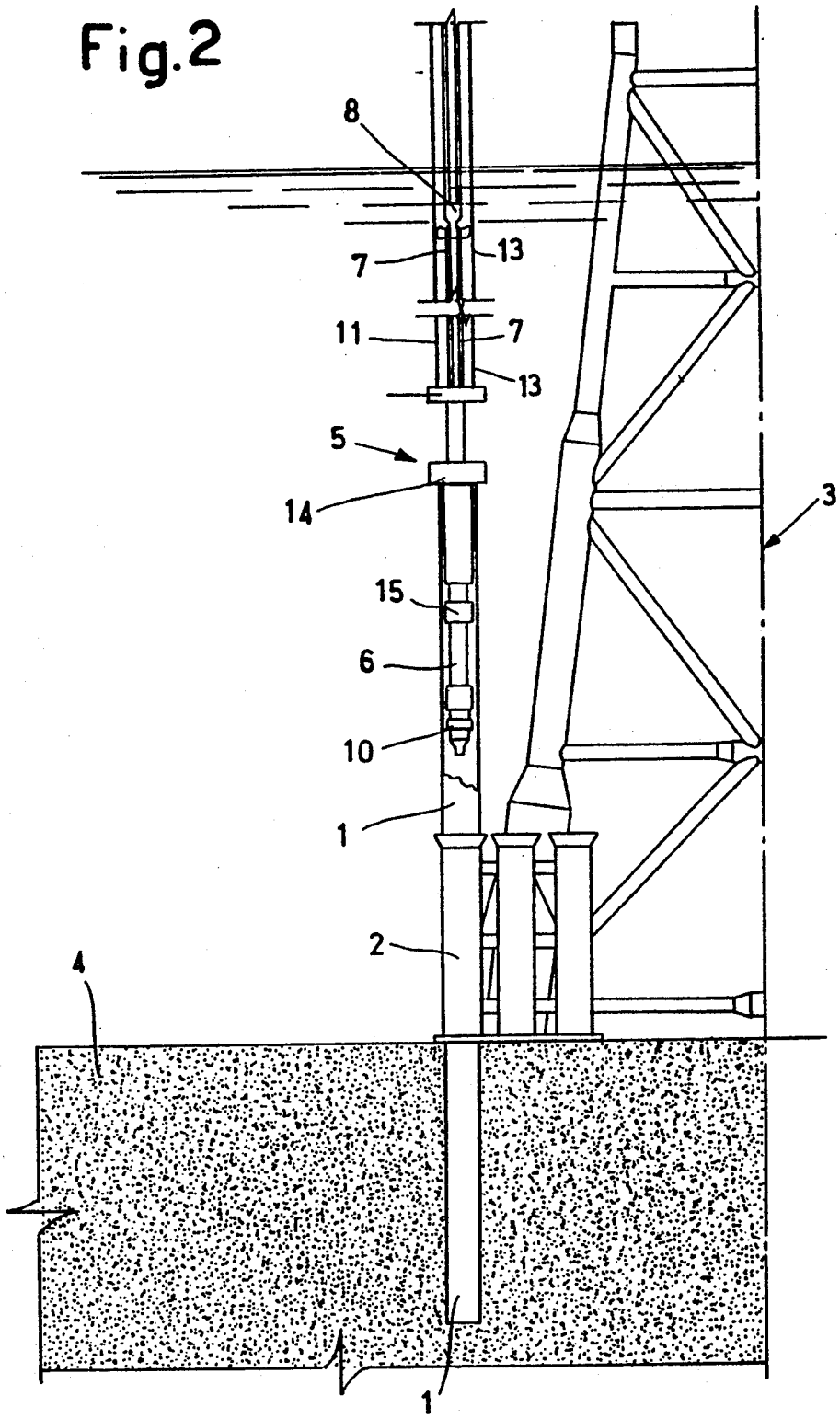
FIG. 2 is a view analogous to that of FIG. 1 after the pile has been hammered by the device of the invention.
Figure 3:
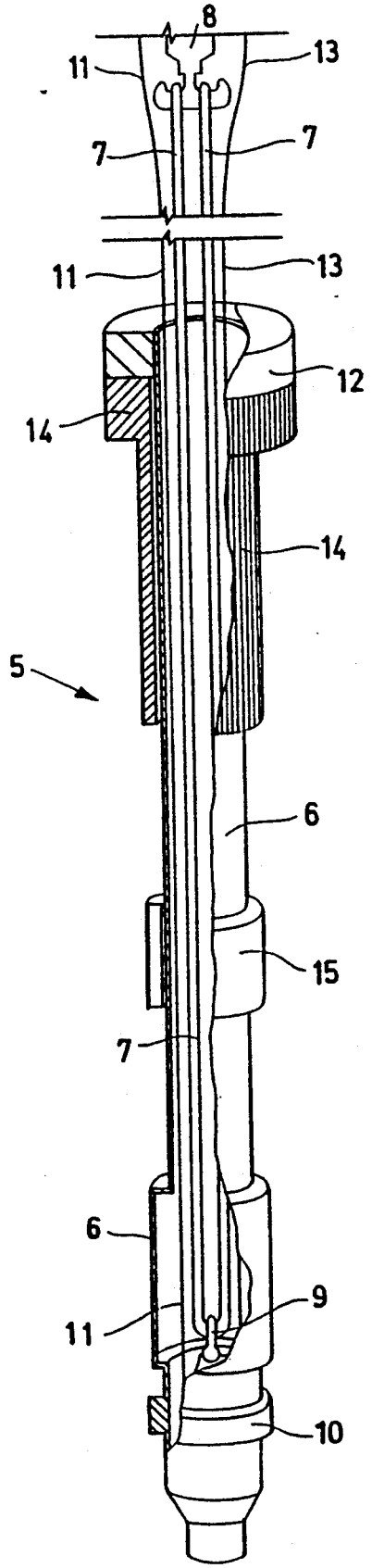
FIG. 3 is a partly sectional perspective view of the lifting and hammering device of FIG. 1 to an enlarged scale.
Figure 6:
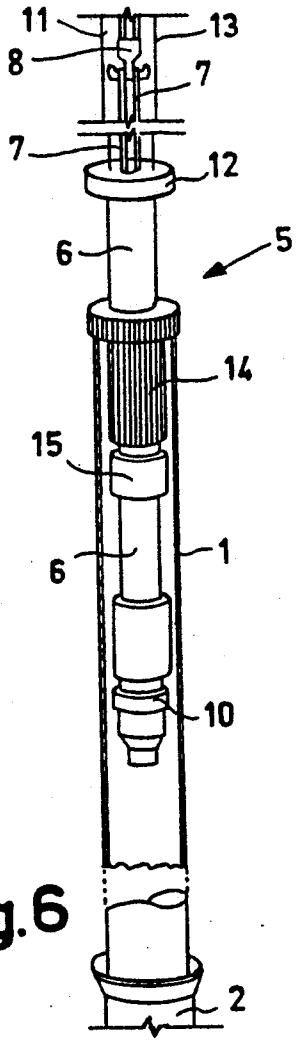
FIGS. 4, 5 and 6 are partly sectional partial perspective views showing the various operating stages of the lifting and hammering device according to the invention.
Figure 5:
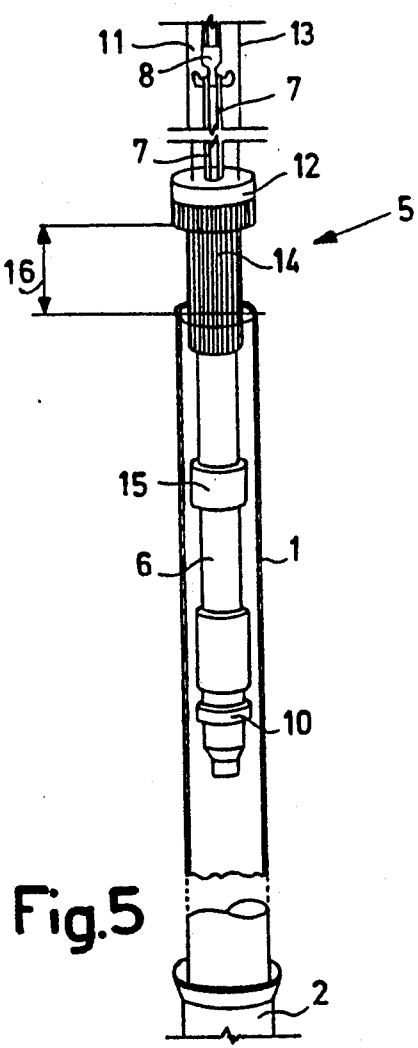

At this point the clamp 10 is disengaged and the entire device 5 is raised by said crane until a level difference 16 is achieved (see FIG. 5) which is equal to that falling distance for the striking weight or hammer 14 determined by design calculations, after which the electromagnet 12 is de-energized so that the striking weight, no longer retained, collides against the head of the pile 1 to drive said pile into the sea bed 4 (see FIGS. 2 and 6).

The support element 6 is then lowered until the electromagnet 12 makes contact with the striking weight 14, which is again rigidly retained by the electromagnet by energizing this latter, after which the described cycle is repeated.

I claim:

1. A device for lifting and hammering foundation piles into the sea bed for offshore structures from a crane situated on a pontoon, said device comprising a a guide suspended from the crane, a hammer slidable along the guide, a long support element for insertion into the foundation pile to be driven into the sea bed, an expansion-type gripping clamp for said foundation pile being provided at one end of said support element, and a limit stop on said support element for stopping said hammer and absorbing the impact thereof.

2. A device for lifting and hammering the foundation piles of offshore structures as claimed in claim 1, wherein said support element further comprises a length of the order of twenty meters.

3. A device for lifting and hammering the foundation piles of offshore structures as claimed in claim 1, wherein said hammer is of ferrous material, and an electromagnet is fixed to said support element for magnetically engaging said hammer.

4. A device for lifting and hammering foundation piles into the sea bed for offshore structures from a crane situated on a pontoon, said device comprising a guide suspended from the crane, a hammer of ferrous material slidable along the guide, a long support element for insertion into the foundation pile to be driven into the sea bed, a limit stop on said support element for stopping said hammer and absorbing the impact thereof, and an electromagnet fixed to said support element for magnetically engaging said hammer.

* * * * *